US007278517B2

(12) United States Patent
Gut

(10) Patent No.: US 7,278,517 B2
(45) Date of Patent: Oct. 9, 2007

(54) ELEVATOR INSTALLATION WITH A DEVICE FOR FURNISHING A TEMPORARY PROTECTIVE SPACE, A METHOD FOR MOUNTING THE DEVICE AND A METHOD FOR FURNISHING THE TEMPORARY PROTECTIVE SPACE

(75) Inventor: Hubert Gut, Udligenswil (CH)

(73) Assignee: Inventio AG, Hergiswil NW (CH)

( * ) Notice: Subject to any disclaimer, the term of this patent is extended or adjusted under 35 U.S.C. 154(b) by 139 days.

(21) Appl. No.: 10/838,850

(22) Filed: May 4, 2004

(65) Prior Publication Data

US 2004/0222046 A1 Nov. 11, 2004

(30) Foreign Application Priority Data

May 7, 2003 (EP) ..... 03405320

(51) Int. Cl.
*B66B 1/26* (2006.01)

(52) U.S. Cl. ..... 187/300; 187/301; 187/360; 187/370

(58) Field of Classification Search ..... 187/300, 187/301, 302, 360; 254/269
See application file for complete search history.

(56) References Cited

U.S. PATENT DOCUMENTS

| | | | | |
|---|---|---|---|---|
| 3,211,258 | A * | 10/1965 | Dickmann | 187/389 |
| 5,411,117 | A * | 5/1995 | Hayrinen | 187/360 |
| 5,613,576 | A * | 3/1997 | Lamb | 187/355 |
| 5,806,633 | A * | 9/1998 | Macuga | 187/357 |
| 6,736,242 | B2 * | 5/2004 | Nygren | 187/357 |
| 6,758,310 | B2 * | 7/2004 | Muff et al. | 187/370 |

FOREIGN PATENT DOCUMENTS

| | | |
|---|---|---|
| EP | 1118574 | 7/2001 |
| JP | 10-45347 A | 2/1998 |

* cited by examiner

*Primary Examiner*—Patrick Mackey
*Assistant Examiner*—Terrell Mathews
(74) *Attorney, Agent, or Firm*—Fraser Clemens; Martin & Miller LLC; William J. Clemens

(57) ABSTRACT

A device provides an elevator installation with a shortened car travel path to establish a temporary protective space below and/or above the car upon activation of the car safety brake device. The speed limiter cable is limited, independently of the speed limiter, in a travel path by a switchable stop device. This limitation causes an actuation of the car safety brake device in the corresponding travel direction.

16 Claims, 3 Drawing Sheets

Fig I
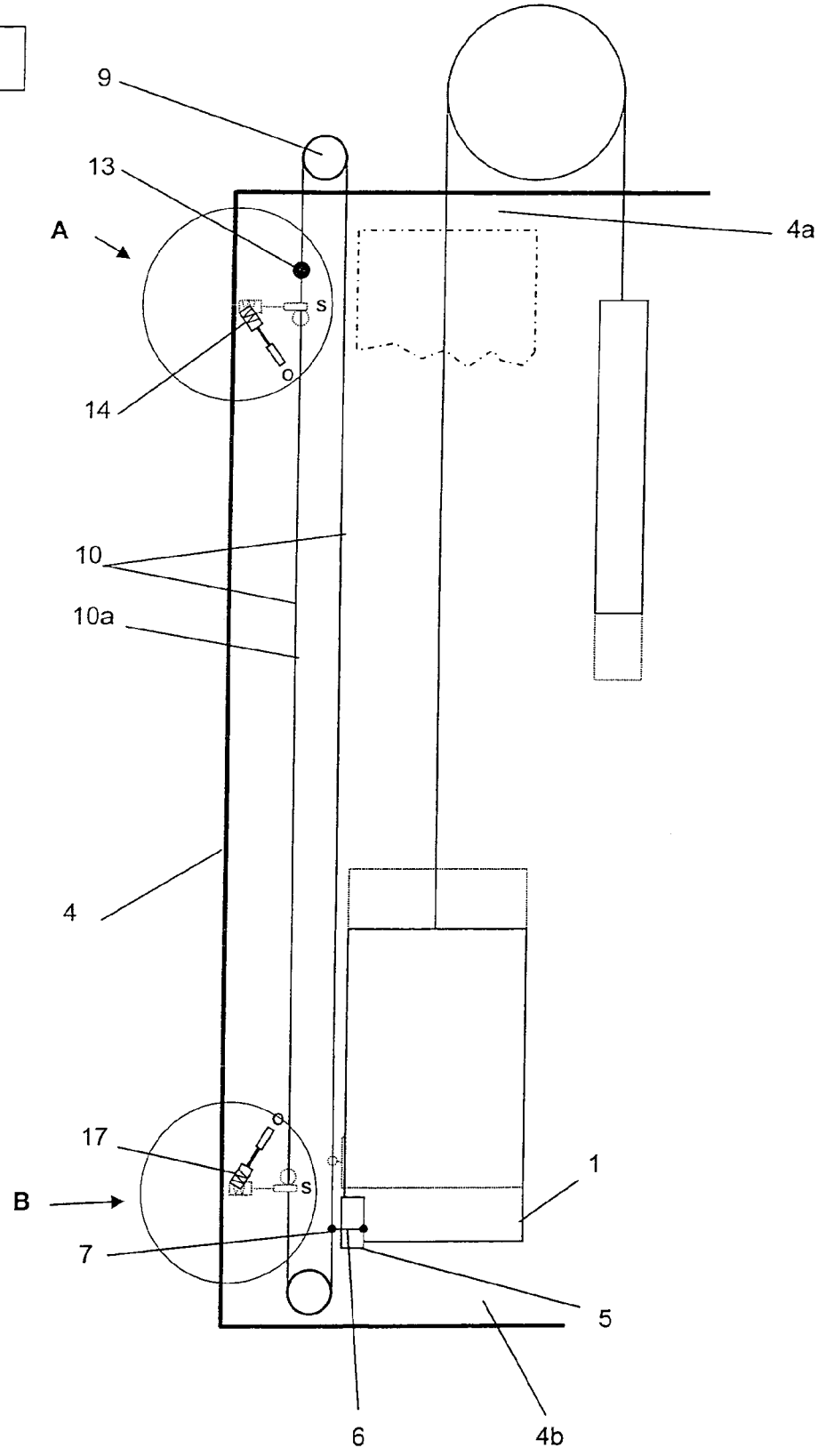

Fig II Detail A
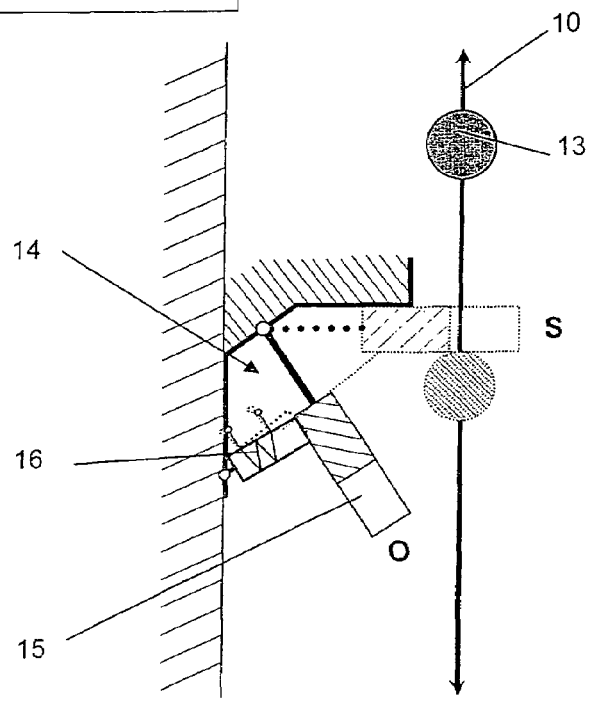
Fig IV
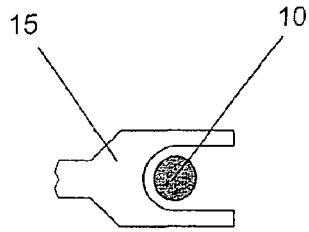
Fig III Detail B
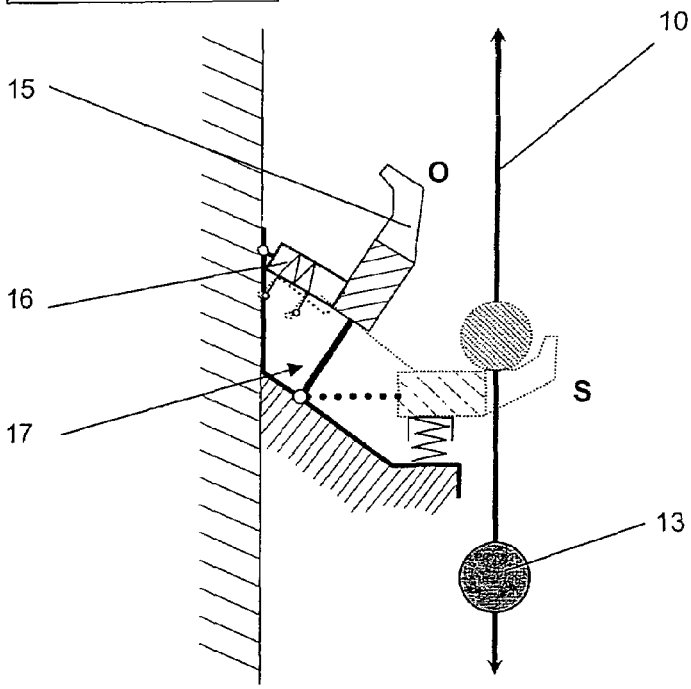

Fig V
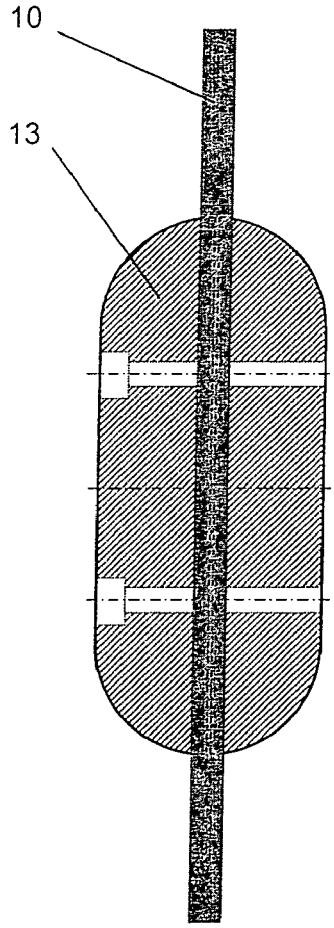
Fig VI
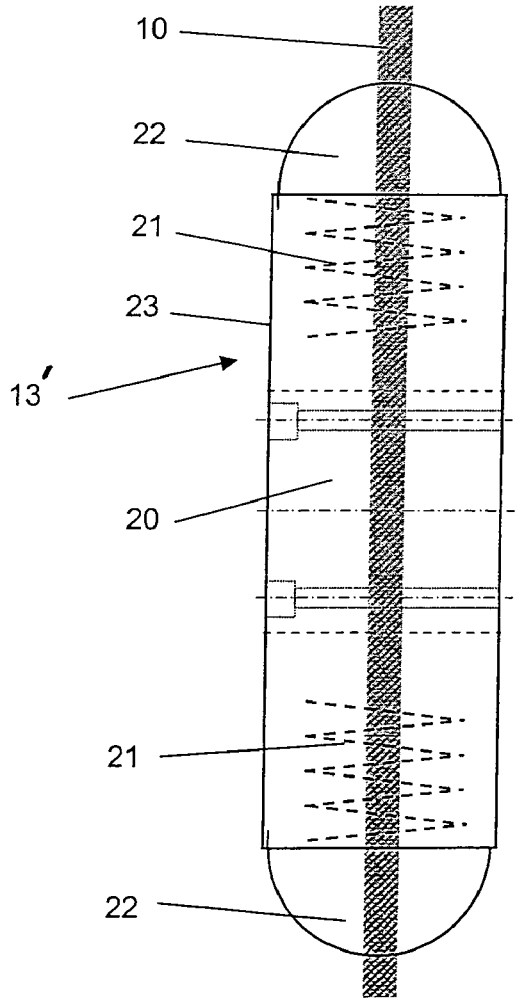

ELEVATOR INSTALLATION WITH A DEVICE FOR FURNISHING A TEMPORARY PROTECTIVE SPACE, A METHOD FOR MOUNTING THE DEVICE AND A METHOD FOR FURNISHING THE TEMPORARY PROTECTIVE SPACE

BACKGROUND OF THE INVENTION

The present invention relates to an elevator installation, with a device for furnishing a temporary zone of protection, a method for mounting the device and a method for furnishing the temporary zone of protection, which device is preferably used for modernization of existing buildings or for new installations.

The elevator installation is installed in a shaft. It essentially consists of a car that is connected with a counterweight by way of support means. The car is moved along a substantially vertical car travel path by means of a drive that selectively acts on the support means or directly on the car or the counterweight. For protection of maintenance personnel, minimum protective spaces are provided in the end zones of the car travel path. The protective space ensures that the maintenance personnel, who stand in the protective space or on the car, are not put at risk even in the case of unexpected movements of the car. If in the case of existing buildings an elevator installation is newly fitted or the travel speed of the car is increased, in many instances an insufficient length of car travel path is available. The necessary minimum protective spaces cannot be provided.

If only an insufficient protective space is available, the car travel path is usually limited at the time of maintenance or when a person stands in the shaft or on the car so that the requisite protective space can be temporarily provided. The car travel path limited in that matter is termed a shortened shaft region.

An elevator installation is shown in the European patent document EP 1 118 574 in which a temporary protective space is ensured under the travel frame by activation of at least one braking device which is present. The activation is effected by, for example, the speed limiter.

The problem of this solution is that an activation by the speed limiter presupposes taking into consideration the positional information of the car, since the car, as long as it is not located in the critical end zones, has to continue travelling. This causes an increase in cost of the drive control. In addition, the drive control is not readily obvious and thereby makes visual checking by the maintenance expert difficult. Due to the conventionally usual method of triggering the speed limiter there is uncertainty with respect to the instant of actuation of the braking device, since the blocking distance of the speed limiter, for example cam distance and build up of frictional force at the speed limiter, can be difficult to define.

SUMMARY OF THE INVENTION

The present invention has the object of proposing a simple actuation of the car braking device for furnishing a temporary protection space and a method of furnishing the same, which eliminates the problems outlined in the foregoing, is economic and permits simple mounting.

In that case the car safety brake device attached to the car and acting at one side or at both sides is actuated by the speed limiter cable. The speed limiter cable is connected at one end with the actuating unit of the car safety brake device. It is led in a first portion to the speed limiter, loops the speed limiter arranged in the shaft head or engine room and runs, in the counter run, parallel to the first portion to the deflecting and tensioning roller, which is arranged in the shaft pit, of the speed limiter system. From there the speed limiter cable is led in the second portion back to the connecting point at the actuating unit of the car safety brake device and fastened. On stopping of the speed limiter cable, the car safety brake device is actuated in correspondence with the travel direction of the car and the car safety brake device brings the car to a safe stop. Depending on the mode of construction of the car safety brake device, the stopping function is given only in a downward travel direction or is given in both travel directions. According to the present invention, an abutment is fastened in the speed limiter cable. The abutment follows a travel path corresponding with the car travel path. Fixedly mounted in the shaft is at least one stop device which can be moved out and which, in the moved-out setting (the stopping position), stops the abutment, which is fastened to the speed limiter cable, in the corresponding travel direction so that the speed limiter cable stops, whereby the car safety brake device is actuated. The fastening point of the stop device in the shaft thus limits the travel path of the car in the associated travel direction. Through arrangement of a respective stop device in the upper region of the shaft and in the lower region of the shaft a temporary protective space can be furnished at both ends of the car travel path if a car safety brake device acting at both sides is used at the car. The temporary protection space at the lower end of the car travel path is termed a lower temporary protection space and the temporary protection space at the upper end of the car travel path is termed an upper temporary protection space.

The illustrated solution gives an economic possibility for creation of a temporary protection space. It is simple to install and the function can be visually checked by maintenance personnel at any time, since the setting of the stop device is readily apparent in visual terms.

In the stopping position, i.e. in the moved-out setting of the stop device, the normal operation of the elevator installation is blocked. Depending on the control figuration, journeys at low speed are possible as long as the elevator car is located within the now shortened shaft region. An optimum service-friendliness of the elevator installation is thereby given. A further positional checking before engagement of the stop device is redundant, since the car can move at any time within the shortened shaft region.

DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 1 is a schematic view of an elevator installation with a reduced shaft pit depth and a reduced shaft head height provided by blocking devices according to the present invention;

FIG. 2 is an enlarged view of the first blocking device shown in a portion "A" of FIG. 1;

FIG. 3 is an enlarged view of the second blocking device shown in a portion "B" of FIG. 1;

FIG. 4 is an enlarged fragmentary view of one of the forks shown in FIGS. 2 and 3;

FIG. 5 is an enlarged fragmentary view of the abutment shown in FIGS. 1-3; and FIG. 6 is a view similar to FIG. 5 of an alternate embodiment of the abutment.

DESCRIPTION OF THE PREFERRED EMBODIMENT

One possible overall arrangement of an elevator installation utilizing the device according to the present invention is illustrated in FIG. 1. The illustrated elevator installation requires a temporary protective space at both ends (upper end 4*a* and lower end 4*b*) of a car travel path. A car 1 is provided with a car safety brake device 5 acting at both sides. The car safety brake device 5 is actuated by a speed limiter 9 by way of an associated actuating unit 6 for the safety brake device 5 and a speed limiter cable 10 in the case of excess speed of the car 1. The actuated car safety brake device 5 brings the car 1 to a standstill.

According to the present invention, an abutment 13 is fastened in the speed limiter cable 10. A first stop device 14 is fastened at the top, and a second stop device 17 at the bottom, in a shaft 4. As shown in FIGS. 2 and 3, forks 15 at the top and bottom stop devices 14, 17 are brought by an actuating element 16 into a stopping position S or into an open position O. In the open position O, the abutment 13 can pass the stop devices 14, 17 unhindered. Thus, the car 1 can reach the end positions provided in accordance with the elevator installation. In the stopping position S, the abutment 13 is limited in its travel path by the stop devices 14, 17. The abutment 13 fastened to the speed limiter cable 10, on reaching one of the stop devices 14, 17, stops the speed limiter cable 10, which thus actuates the car safety brake device 5 and necessarily leads the car 1 to a standstill. The car 1 can no longer reach the end positions of the shaft 4. The requisite temporary protective spaces 4*a*, 4*b* at the lower and upper ends respectively of the car travel path are thus provided. The illustrated solution gives an economic possibility for securing the requisite temporary protective space. It is simple to install and the function can be visually checked at any time by the maintenance personnel, since the setting of the stop devices 14, 17 is readily apparent visually.

In a preferred version, each of the stop devices 14, 17 is additionally designed in such a manner, as shown in FIGS. 2 and 3, that it can apply the required actuating force in only one travel direction and does not obstruct movement in the opposite travel direction. This allows that a special monitoring unit does not have to observe the location of the car 1 on movement out of the stop devices 14, 17. If, for example, the car 1 is disposed at the lowermost stop when the stop device 17 is moved out, i.e. within the space 4*b* to be protected, the stop device 17 nevertheless can be moved out to the stopping position S. A risk does not thereby arise, since access to the shaft pit is blocked via the car 1 standing at the lowermost stop. However, the car 1 can now be moved at low speed to outside the protective space 4*b* without this being prevented by the stop device 17. However, after travelling past the stop device 17 in the opposite direction return travel into the protective space 4*b* is prevented.

The advantage of this solution is to be seen in that on the one hand the elevator installation can be moved in a simple manner for maintenance purposes, but, also in evacuation operation, the evacuation is not prevented by the illustrated solution.

In a preferred version, the abutment 13 is, as illustrated in FIG. 1, arranged in a counter run 10*a* of the speed limiter cable 10. This has the advantage that a large measure of freedom exists in placement of the stop devices 14, 17, since there is no collision with the actuating unit 6 of the safety brake device 5.

Alternatively, the abutment 13 is connected together with a coupling point 7 at the actuating unit 6 of the safety brake device 5 to form a subassembly. In the individual case this enables a better possibility of placement of the stop devices 14, 17.

The abutment 13 is constructed, as shown in FIG. 5 by way of example, in the form of a cylinder with rounded end regions. It is clamped onto the speed limiter cable 10 in the counter run 10*a* of the speed limiter cable 10 or forms, together with the coupling point 7, a subassembly. The embodiment shown in FIG. 5, without a specific resilient characteristic, is primarily suitable for car safety brake devices 5 with a blocking function. This embodiment is particularly economic to realize and simple to install.

In the case of an alternate embodiment abutment 13' shown in FIG. 6, opposed abutment ends 22 are connected with an abutment block 20 by means of biased springs 21. The abutment block 20 is clamped onto the speed limiter cable 10 in the counter run 10*a* of the speed limiter cable or forms, together with the coupling point 7, a subassembly. The abutment ends 22 and springs 21 are guided in a guide 23. This embodiment makes possible for the speed limiter cable 10, after actuation of the car safety brake device 5, a further movement in correspondence with the stopping travel of the car 1, wherein the abutment ends, after resetting of the car 1 into the shortened shaft region, automatically return to the starting setting. This embodiment is preferably suitable for car safety brake devices 5 with a braking characteristic (braking safety brake devices).

The stop devices 14, 17 are preferably constructed, as shown in FIG. 4, in the form of a fork 15. The fork 15 in the stopping position S of the stop device 14, 17 encloses the speed limiter cable 10 on three sides. The speed limiter cable 10 is thereby substantially guided. This embodiment is economic and simple to execute.

If the fork 15 of the stop device 14, 17 is supported, for example as shown in FIG. 3, by means of a resilient element on the shaft wall support, there is similarly made possible for the speed limiter cable 10 a further movement in correspondence with the stopping travel of the car 1. The proposed construction allows the fork 15 to push back into the desired setting as soon as the car 1 is reset into the shortened shaft region.

The position of the stop device 14, 17 is, as illustrated in FIGS. 2 and 3, preferably controlled in each instance by the actuating element 16 in the form of a stroke magnet. This enables a reliable and cost-optimal actuation of the stop devices 14, 17 in correspondence with the desired control.

If a car safety brake system acting at both sides is used, a respective stop device is employed for limiting the travel path in both end zones. In the case of fastening of the abutment 13 in the counter run 10*a*, the stop device 14 installed in the upper shaft region is, as shown in FIGS. 1, 2 and 3, used for furnishing a temporary protective space at the bottom and in the case of a corresponding requirement the stop device 17 is selectively employed in the lower shaft region for furnishing a temporary protective space at the top. The association is correspondingly changed with the arrangement of the abutment 13 at the coupling point 7. The optional use of the stop devices 14, 17 allows a solution, which is appropriate to requirements and thus cost-efficient, for furnishing a temporary protective zone.

The parts required for furnishing a temporary protective zone, such as the abutment 13, one or more stop devices 14, 17 and switching elements, can be mounted in a simple manner in the elevator installation. The function is readily apparent. The device according to the present invention is suitable for existing installations and also for new installations.

The stopping position S of the abutments 14, 17 is electrically monitored (not illustrated in the figures). A normal travel is thus prevented in the stopping position S. On actuation of the car safety brake device 5, a safety contact of the car safety brake device 5 is necessarily opened, which leads to an electrical switching-off of the drive. A provided evacuation device (not shown) enables a return movement of the car from the overrun zone into the shortened shaft region. A rapid evacuation of trapped persons is thereby possible.

Several possibilities exist for controlling or switching the stop device for the stop devices 14, 17. The stop devices 14, 17 are advantageously moved out on manual opening of a shaft closure, for example for carrying out maintenance operations within the shaft 4. A resetting of the stop devices 14, 17 can be undertaken only from outside the shaft 4 by an authorized person. Checking of the authorization is carried out by known elements such as a key, input of a code or a similar method. Alternatively, the resetting can be blocked by additional systems such as, for example, detectors of a presence in the shaft space. In the case of multiple shafts, the stop devices 14, 17 can additionally be checked by monitoring of the intermediate barriers. The intermediate barriers are, for example, gratings which are installed between two adjacent car travel paths and which are usually provided with passage openings.

With knowledge of the present invention the elevator expert can change the set forms and arrangements as desired. For example, the illustrated pivot format of the stop devices can also be replaced by a thrust format or there can be used, for switching the stop device, apart from stroke magnets, also other mechanical elements such as, for example, Bowden pulls, or electromagnetic elements such as, for example, setting motors, other electromagnets or further elements.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A device for an elevator installation having a car movable in a shaft, and a car safety brake device acting on the car and being actuable by a speed limiter cable, the device comprising:

at least one abutment fastened to one of the speed limiter cable and an actuating unit for the safety brake device; and at least one stop device switchable between an open position and a stopping position and fastened in the shaft for blocking movement of the speed limiter cable when in said stopping position and in cooperation with said at least one abutment to actuate the safety brake device and prevent movement of the car whereby said at least one stop device is not switched to said stopping position in response to an overspeed condition of the car.

2. The device according to claim 1 wherein said at least one stop device is mounted in an upper end of the shaft and said at least one stop device cooperates with said at least one abutment to provide a lower temporary protection space in the shaft when said at least one stop device is in said stopping position.

3. The device according to claim 2 including another stop device mounted in a lower end of the shaft and wherein said at least one abutment and said another stop device cooperate to provide an upper temporary protection space in the shaft when said another stop device is in an associated stopping position.

4. The device according to claim 1 wherein said at least one stop device is mounted in a lower end of the shaft and said at least one abutment and said at least one stop device in said stopping position cooperate to provide an upper temporary protection space in the shaft.

5. The device according to claim 1 wherein said at least one abutment is fastened to a counter run of the speed limiter cable.

6. The device according to claim 1 including a coupling point attached to the actuating unit, said coupling point and said at least one abutment being connected to form a subassembly.

7. The device according to claim 6 wherein when said at least one stop device is mounted in an upper end of the shaft, said at least one abutment and said at least one stop device cooperate to provide an upper temporary protection space in the shaft when said at least one stop device is in said stopping position.

8. The device according to claim 7 including another stop device mounted in a lower end of the shaft and wherein said at least one abutment and said another stop device cooperate to provide a lower temporary protection space in the shaft when said another stop device is in an associated stopping position.

9. The device according to claim 6 wherein when said at least one stop device is mounted in a lower end of the shaft, said at least one abutment and said at least one stop device cooperate to provide a lower temporary protection space in the shaft when said at least one stop device is in said stopping position.

10. The device according to claim 1 wherein said at least one abutment has a cylinder shape with round ends and is clamped to the speed limiter cable.

11. The device according claim 1 wherein said at least one abutment includes means providing a further limited movement of the car when said at least one abutment engages said at least one stop device.

12. The device according claim 11 wherein said means providing a further limited movement includes a spring biasing an abutment end of said at least one abutment.

13. The device according to claim 1 wherein said at least one stop device includes a fork shaped to enclose the speed limiter cable on three sides and block said at least one abutment in said stopping position.

14. The device according to claim 1 wherein said at least one stop device includes an electrically actuated magnet for switching into said stopping position.

15. A method of mounting a device for providing a temporary protection space in an existing or new elevator installation shaft in which a car is braked by a car safety brake device actuable by blocking a speed limiter cable, comprising the steps of:

a) fastening at least one abutment to the speed limiter cable; and b) mounting at least one switchable stop device in the shaft relative to the speed limiter cable whereby when the at least one stop device is switched to a stopping position, the at least one stop device engages the at least one abutment and blocks the speed limiter cable, said at least one stop device not being switched to said stopping position in response to an overspeed condition of the car.

16. A method of furnishing a temporary protection space above and/or below a car in an elevator shaft in which the car is braked by a car safety brake device actuable by blocking a speed limiter cable, comprising the steps of:

a) fastening at least one abutment to the speed limiter cable;

b) mounting at least one switchable stop device in the shaft; and c) switching the at least one switchable stop device to a stopping position whereby the at least one switchable stop device engages the at least one abutment to limit travel of the speed limiter cable and prevent the car from entering a protection space in the shaft, said at least one stop device not being switched to said stopping position in response to an overspeed condition of the car.

* * * * *